US010023444B2

(12) United States Patent
Huber et al.

(10) Patent No.: US 10,023,444 B2
(45) Date of Patent: Jul. 17, 2018

(54) CONSTRUCTION MACHINE AND METHOD FOR UPWARD AND DOWNWARD MOVEMENT OF A LIFTING ELEMENT

(71) Applicant: BAUER Maschinen GmbH, Schrobenhausen (DE)

(72) Inventors: Ludwig Andreas Huber, Thalhausen (DE); Johannes Sedlmeier, Jetzendorf (DE); Leonhard Weixler, Thierhaupten (DE)

(73) Assignee: BAUER Maschinen GmbH, Schrobenhausen (DE)

( * ) Notice: Subject to any disclaimer, the term of this patent is extended or adjusted under 35 U.S.C. 154(b) by 39 days.

(21) Appl. No.: 15/258,255

(22) Filed: Sep. 7, 2016

(65) Prior Publication Data

US 2017/0066633 A1 Mar. 9, 2017

(30) Foreign Application Priority Data

Sep. 9, 2015 (DE) ..... 10 2015 115 146

(51) Int. Cl.
*B66C 13/16* (2006.01)
*B66D 1/26* (2006.01)
(Continued)

(52) U.S. Cl.
CPC ..... *B66D 1/26* (2013.01); *B66C 13/18* (2013.01); *B66C 13/46* (2013.01); *B66C 23/06* (2013.01);
(Continued)

(58) Field of Classification Search
CPC ..... B66C 13/08; B66C 13/16; B66C 13/44; B66C 13/46; B66D 1/26; B66D 1/34; B66D 5/02
See application file for complete search history.

(56) References Cited

U.S. PATENT DOCUMENTS 3,901,478 A * 8/1975 Peterson ..... B66C 13/02 188/71.2
4,033,553 A * 7/1977 Sugimoto ..... B66D 1/24 192/215
(Continued)

FOREIGN PATENT DOCUMENTS

DE 699 20 846 T2 11/2005
GB 826 133 A 12/1959
WO 2006/013053 A1 2/2006

OTHER PUBLICATIONS

The extended European search report issued by the European Patent Office on Feb. 7, 2017, which corresponds to European Patent Application No. 16178836.9-1731 and is related to U.S. Appl. No. 15/258,255; 3pp.
(Continued)

*Primary Examiner* — Emmanuel M Marcelo
(74) *Attorney, Agent, or Firm* — Studebaker & Brackett PC

(57) ABSTRACT

The invention relates to a construction machine having a mast and a lifting element which can be moved up and down along the mast with a hoist rope. The hoist rope can be activated by means of two rope winches. At least one first rope winch is designed as a free fall winch, wherein the hoist rope can be lowered in free fall. To lower the hoist rope a controller is provided, with which the first rope winch, which is designed as a free fall winch, can be switched into a free fall mode. Meanwhile, a second rope winch is operated in force-locking manner.

15 Claims, 2 Drawing Sheets

Figure 1:
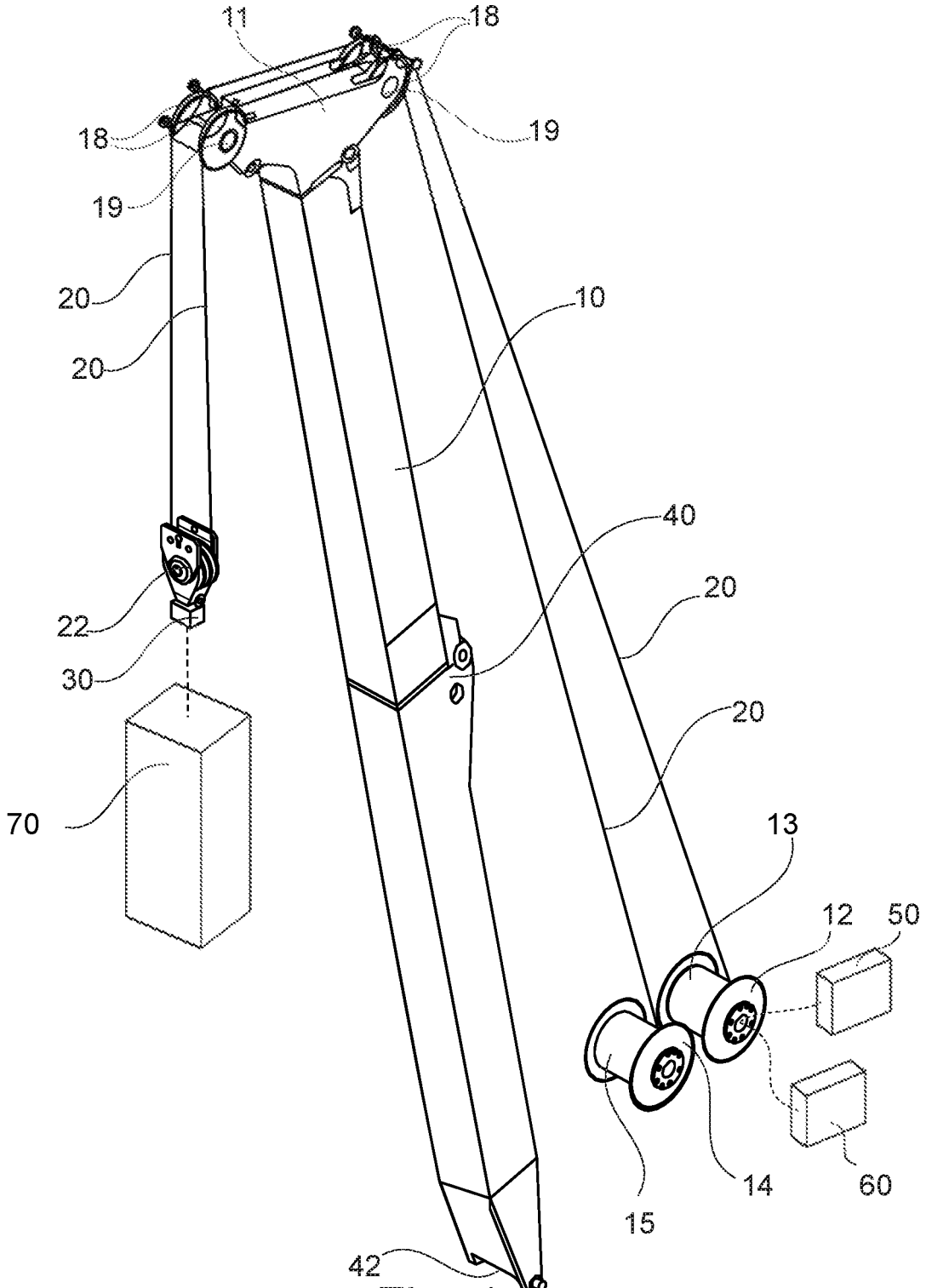

(51) Int. Cl.

| | |
|---|---|
| ***B66D 5/02*** | (2006.01) |
| ***E02F 3/47*** | (2006.01) |
| ***E02F 3/58*** | (2006.01) |
| ***B66C 13/18*** | (2006.01) |
| ***B66C 23/06*** | (2006.01) |
| ***B66C 13/46*** | (2006.01) |
| ***B66C 23/62*** | (2006.01) |

(52) U.S. Cl.
CPC ..... *B66C 23/62* (2013.01); *B66D 5/02* (2013.01); *E02F 3/47* (2013.01); *E02F 3/58* (2013.01); *B66C 2700/03* (2013.01)

(56) References Cited

U.S. PATENT DOCUMENTS 4,231,698 A * 11/1980 Lado ..... B66C 3/125 254/315
4,398,698 A * 8/1983 Crawford ..... B66D 5/26 254/291
4,432,532 A * 2/1984 Overholt ..... B66D 1/08 254/291
5,020,962 A * 6/1991 Ramun ..... E04G 23/08 212/167
5,653,350 A * 8/1997 Maki ..... B66C 1/585 212/197
6,926,260 B1 * 8/2005 De Groot ..... B66D 3/043 254/277
2002/0100642 A1 * 8/2002 Mehrman ..... A63G 31/00 185/14
2007/0290182 A1 * 12/2007 Noeske ..... B66C 13/18 254/327
2010/0018055 A1 * 1/2010 Lynderup ..... B66C 1/108 29/889
2015/0379783 A1 * 12/2015 Sallee ..... G07C 3/00 254/266

OTHER PUBLICATIONS

An Office Action issued by the Chinese Patent Office dated Sep. 29, 2017, which corresponds to Chinese Patent Application No. 201610812025.0 and is related to U.S. Appl. No. 15/258,255; with English translation.
An Office Action issued by the Korean Patent Office dated Dec. 20, 2017, which corresponds to Korean Patent Application No. 10-2016-0113654 and is related to U.S. Appl. No. 15/258,255; with English translation.
Shitong Chen et al., "Structure and operating principle of a speed-controlled load-lowering winch", Engineering Machinery and Maintenance, Jul. 4, 214, p. 146-147.
Yutao Liu, "Research on Hydraulic Diaphragm Wall Grab and the Control System", Database for Chinese Excellent MS Theses, Engineering Science II, No. 5, 2012, pp. 1-49.

* cited by examiner

CONSTRUCTION MACHINE AND METHOD FOR UPWARD AND DOWNWARD MOVEMENT OF A LIFTING ELEMENT

The invention relates to a construction machine having a mast and a lifting element which can be moved up and down along the mast with a hoist rope, which can be activated by means of two rope winches, according to the preamble to claim 1.

The invention further relates to a method for upward and downward movement of a lifting element in a construction machine, wherein a hoist rope is activated with two rope winches, according to the preamble to claim 12.

For upward and downward movement of a tool or a load with a construction machine, a rope winch with a hoist rope and a lifting element can be provided on the construction machine. The hoist rope is connected at one end to the rope winch and can be wound onto it and out of it. The tool to be moved upwards and downwards or the load is arranged on the lifting element. In particular for upward and downward movement of heavy tools, for example a hydraulic gripper to create a diaphragm wall, or other large loads, the ends of the hoist rope are each connected to a rope winch. The two winch drives of the rope winches are operated synchronously. Furthermore for upward and downward movement of the tool or the load, approximately the same torque is provided at both rope winches by the winch drives.

An advantage with such a method for upward and downward movement of a tool or a load is that the entire weight of the tool or the load does not have to be moved by only one rope winch. Instead, the weight can be moved jointly by the two winches secured to the construction machine or its mast.

Construction machines having two rope winches for upward and downward movement of a tool or a load enable works to be carried out safely, in particular also with heavy tools or loads. Such construction machines can be for example a diaphragm wall gripper which has a mast, a carrier unit and a mobile undercarriage.

For upward and downward movement of the tool or the load, however, the two rope winches of such a construction machine must be operated synchronously, i.e. with the same winding-in and letting-out speed, to lift and lower the tool or the load. The hoist rope is let out by both rope winches and the tool or the load is lowered through a force-locking release of the hoist rope by the rope winches in a controlled but time-consuming manner.

It is the object of the invention to indicate a construction machine and a method for activating a hoist rope, with which safe upward and downward movement of a lifting element can be carried out particularly efficiently.

The object is achieved according to the invention on the one hand by a construction machine having the features of claim 1 and on the other hand with a method having the features of claim 12. Preferred embodiments of the invention are indicated in the respective dependent claims.

The construction machine according to the invention is characterised in that at least one first rope winch is designed as a free fall winch, wherein the hoist rope can be lowered with free-wheeling and in that a controller is provided, with which the first rope winch, which is designed as a free fall winch, can be switched to a free fall mode to lower the hoist rope, while a second rope winch is operated in a force-locking manner.

According to the meaning of the invention a free fall winch can be understood to be a winch which can release and wind out, or let out, a hoist rope with free-wheeling. The free-wheel release or winding out can thereby be produced by the gravitational force of a tool or a load which can be connected to the hoist rope by means of a lifting element.

Furthermore according to the meaning of the invention, a free fall mode can be understood to be a mode, wherein a hoist rope is essentially not braked or operated with force-locking in another way during free fall lowering.

A core idea of the invention can be seen in that to lower the hoist rope the two rope winches can be operated asynchronously, i.e. with different winding-out speeds, in order to facilitate the lowering of the hoist rope with a lifting element, tool and/or a load located thereon with free fall speed. By operating a first rope winch as a free fall winch during lowering, a quick and efficient lowering is achieved. The second rope winch can be designed as a winch operated with force-locking which facilitates a controlled lowering. There is thus a combined operation of a free fall winch and a hoist winch. It was recognised in the invention that by operating two winches asynchronously a hoist rope can be reliably operated with a high free fall speed during lowering. A combination of two free fall winches is also possible.

The free fall speed according to the meaning of the invention can be understood to be a speed which almost corresponds to the speed of the free falling mass of the lifting element, the tool and/or the load during lowering.

In a particularly preferred embodiment of the invention the lifting element is arranged with a pulley block or an articulation unit so that it can be moved on the hoist rope. The pulley block can thereby be guided to move freely on the hoist rope or the articulation unit can be arranged to be movable on the hoist rope. In particular to connect a tool or a load to the lifting element, the lifting element can be hinged to the pulley block or the articulation unit. By hinging the lifting element to the pulley block or the articulation unit the tool or the load can be mounted so that it can be pivoted and/or rotated about one or more axes of articulation relative to the lifting element. The pulley block is additionally used especially for a load compensation, i.e. the load or the weight of the tool is evenly transferred to the hoist rope and the two winches. During upward and downward movement of the lifting element, or lowering and lifting again of the hoist rope, it can be ensured with the pulley block that even in the case of asynchronous operation of the winches, i.e. with different winding-out and winding-in speeds of the winches, the lifting element can be moved up and down along the hoist rope in particular tension-free. This also applies to lowering at free fall speed.

In principle a pulley block can be any rope deflection element. The pulley block can essentially be composed of two flanges lying opposite each other, between which a profiled roller is arranged on a bearing, via which roller a hoist rope can be deflected. The two flanges can thereby be arranged so that they can be folded up.

For operation and maintenance of the construction machine it is advantageous according to a further variant of the invention that the hoist rope is formed by at least two ropes coupled or connected to each other. The two coupled or connected ropes can be connected with rope connectors or coupled with rope couplers. The two winches are thereby connected via the at least two ropes coupled or connected to each other. This embodiment of the invention has the advantage that, in the event of damage or signs of wear, it is not necessary to exchange the whole hoist rope but instead merely the single damaged or worn-out individual rope without having to release both rope connections with the two winches. When connecting individual ropes with a rope connector that has a larger diameter than the ropes, the rope connector can be arranged on the opposite side of the free fall winch, i.e. on the side of the force-locking hoist winch. The free running of the hoist rope through the pulley block during upward and downward movement of the lifting element along the mast is not thereby impaired. In the case of two or more connection points with rope connectors, these can be arranged along the hoist rope so that the upward and downward movement of the lifting element in free fall mode is correspondingly limited. This means that a free fall height can be correspondingly derived through the length of the rope, which is guided in the pulley block and deflected by it and is located between two rope connectors. To monitor the movement of the lifting element between rope connectors, hoist limit switches can also be provided on the hoist rope, which monitor the position of the lifting element, the pulley block and/or the articulation unit. The hoist limit switches can also be used to trigger an alarm if a critical position of the lifting element is reached.

In a further advantageous embodiment of the construction machine according to the invention the free fall winch has a free fall brake, with which the free fall winch can be opened for free fall lowering of the hoist rope and the free falling hoist rope can be braked again by closing, or applying, the free fall brake. If the free fall brake is closed, i.e. activated, the free fall winch can be operated in a force-locking mode. To lower the hoist rope in free fall the free fall brake of the free fall winch can be opened, or deactivated. The free fall winch can thus be operated both in a free fall mode and also in a force-locking mode or operation. If the free fall brake is open it is in the free fall mode and if the free fall brake is closed it is in the force-locking mode. In the force-locking mode the winch can either let out rope, wind in rope, be hydraulically held or locked with a holding brake.

According to a further advantageous variant of the construction machine each rope winch has a winch drum and a first end of the hoist rope is connected to a first winch drum of the first rope winch and a second end of the hoist rope is connected to a second winch drum of the second rope winch. The two winches and the two winch drums can thereby be arranged in principle at any point on the construction machine. An arrangement parallel to or transversely with respect to a pivot axis of the mast of the construction machine is particularly preferred. Furthermore the winch drums can be rotated in the rope winch and are axially mounted therein, and can be wound in and wound out or blocked by the free fall brake or the holding brake.

According to a further development of the invention a particularly useful operation can be achieved in that, after lowering the hoist rope from the starting position into an operating position, a greater hoist rope length is wound out from the first winch drum at the first rope winch than from the second winch drum, and the two rope winches can be operated asynchronously when the hoist rope is lifted again, wherein when it is lifted again a greater hoist rope length is also wound onto the first winch drum than onto the second winch drum. In the starting position the rope sections of the hoist rope are preferably evenly distributed across the first and second winch drum. An equal number of windings can be provided on each winch drum if the winch drums are provided with the same diameter. If the hoist rope is lowered in a free fall, a greater hoist rope length is let out from the first rope winch, which is designed as a free fall winch, than from the second rope winch, which is operated with force-locking in the free fall mode of the first rope winch. Besides such an asynchronous winding-out of the hoist rope in a free fall it can also be provided to wind out the hoist rope from both winch drums in a force-locking operation of the two winches with different winding-out speeds, whereby different hoist rope lengths can also be wound out, or let out, during lowering. In order to restore—after winding the hoist rope back onto the two winch drums—the same winding-in length of the hoist rope and the same number of windings as in the starting position, the rope winches can be operated with correspondingly different speeds so that, upon reaching the starting position, the hoist rope is again evenly distributed across the two winch drums.

In principle, asynchronous operation of the two winches and the two winch drums according to the meaning of the invention is to be understood in that the two winches or winch drums wind in or wind out the hoist rope at different speeds. Different speeds can thereby be composed of two of the following speeds: free fall speed, holding speed (speed equal to zero), a first random speed between the free fall speed and the holding speed, and a second random speed between the free fall speed and the holding speed, which is different from the first random speed. The free fall speed is thereby determined by the gravity of the lifting element and a tool fixed thereto or a load. The speed can be in particular a speed which corresponds approximately to the free fall speed, but is slightly below it, in order to prevent the occurrence of a slack rope during lowering of the hoist rope. For this, a free fall brake can be released only so far that a low residual friction can be maintained when winding the hoist rope out from the winch.

In the invention according to a further advantageous embodiment the hoist rope can be deflected on at least two deflection rollers which are arranged on the mast, and the at least two deflection rollers are mounted on at least one force measuring axis. Deflection rollers are particularly preferably arranged in pairs on the mast head of the mast. By providing a plurality of deflection rollers on the mast head, in particular a plurality of deflection roller pairs, the hoist rope of the construction machine can be brought into an overhanging lowering position of the lifting element and the tool or the load. By mounting the deflection rollers on force measuring axes, in particular by mounting a pair of deflection rollers on a force measuring axis, active external and internal forces engaging on the deflection rollers can be determined and monitored.

For measurement monitoring of the construction machine and the construction works that can be carried out by it, it is advantageous according to a further variant of the invention that the construction machine has sensors, with which a position of the lifting element relative to a position of the construction machine can be determined. Such sensors can be used on the one hand to measure the position of the lifting element during upward and downward movement of the hoist rope and thus to monitor it. This can arise if a winch is in free fall mode and the lifting element is lowered in a free fall. On the other hand such sensors can also be used, when lowering the lifting element, for example into a hole in the ground, to determine the lowering position, for example below the ground surface. Such sensors can preferably be provided on the winches and determine the lengths of the wound-out hoist rope of both winches and evaluate the lengths in particular in real time.

According to a further development of the invention a particularly useful operation can be carried out by the construction machine having rotational speed sensors, with which the rotational speed of at least one of the two rope winches can be determined. The rotational speed sensors, which can be provided on the two rope winches, also allow the speed of the lifting element to be determined during upward and downward movement. Furthermore such rotational speed sensors or absolute sensors can be used to synchronise the winches when the lifting element is lifted again after it has been lowered in free fall.

To guarantee a high flexibility in the operation of the construction machine it is to be regarded as particularly advantageous according to a further variant that at least the first rope winch can be operated both as a free fall winch and also as a force-locking winch. In other words, at least the first rope winch can be switched, besides force-locking operation, also into a free fall mode, wherein a free fall brake is released.

In principle, the construction machine can be any machine for erecting a structure. According to a preferred embodiment variant of the invention the construction machine can be configured as a diaphragm wall gripper to excavate boring material, wherein a hydraulic gripper is arranged on the lifting element. The hydraulic gripper can be a tool which removes earth material with a removal means in a lower area of the gripper and transports it to the earth's surface. As a further tool can be provided for example a chisel.

With respect to the method the aforementioned object is achieved according to the invention in that at least one first rope winch, which is designed as a free fall winch, is used, and the first rope winch is switched into a free fall mode by a controller to lower the hoist rope, while the second rope winch is operated in force-locking operation. The controller further assumes the monitoring of an end position disconnection.

It is hereby ensured that a lifting element in a construction machine can be moved at high speed, in particular at free fall speed. It is further ensured that even during lowering of the hoist rope at free fall speed the hoist rope can at the same time remain connected in a force-locking way to a second rope winch.

In an advantageous variant of the method according to the invention a free fall brake, which is arranged on the at least one first rope winch, is opened, or deactivated, for free-wheeling lowering of the hoist rope and the lifting element, which is arranged on the hoist rope so as to be movable with a pulley block, wherein the at least one first rope winch is released by the free fall brake during the free fall lowering of the hoist rope. During free fall lowering of the hoist rope and the lifting element, in order to activate the free fall brake monitoring sensors can monitor machine status values that are critical to the free fall. Such monitoring sensors can be in particular sensors which are used to determine speeds of machine components or forces and/or loads which engage on these machine components. Machine status values which are provided by the monitoring sensors can be used by a machine operator to decide whether a free fall mode can be carried out, i.e. whether the free fall brake can be activated.

A further embodiment of the method is to be regarded as advantageous according to the invention if the two rope winches are synchronised when the hoist rope and the lifting element, which is arranged on the hoist rope, are lifted again after free-wheeling of the hoist rope into a starting position of the rope winches before lowering, and the two rope winches are operated independently of each other when the hoist rope is lowered and/or lifted again. Synchronisation of the rope winches can be understood in that they are operated with different winding-in speeds in order to produce an even distribution of the hoist rope across the rope winches and the winch drums in the starting position.

Figure 2:
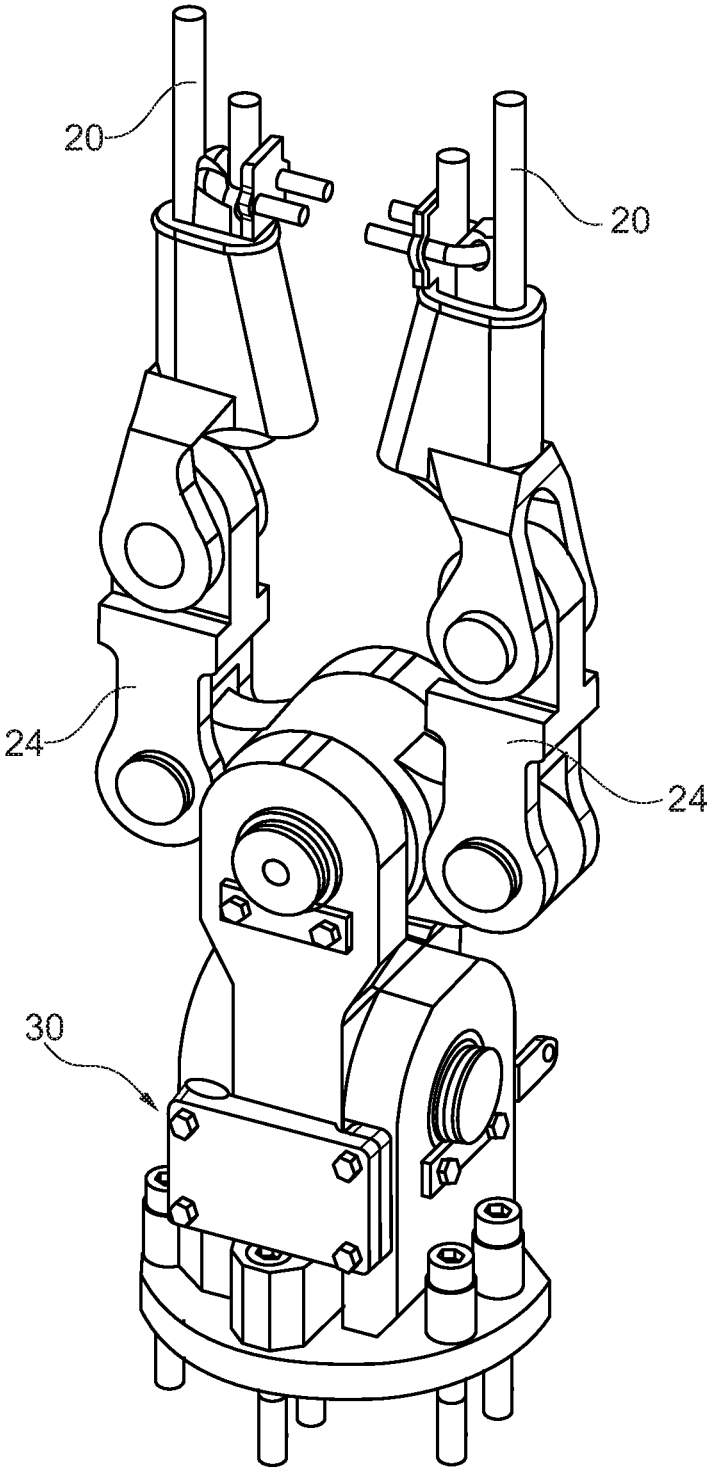

The invention will be explained in further detail below by reference to two preferred exemplary embodiments, which are shown schematically in the attached drawings, in which:

FIG. 1 shows a perspective view of a mast-winch arrangement according to the invention of a construction machine in a first exemplary embodiment with a pulley block; and FIG. 2 shows a perspective view of an articulation unit in place of the pulley block in a second exemplary embodiment.

A first embodiment of the construction machine according to the invention will be explained in more detail below in association with FIG. 1. FIG. 1 shows a mast 10 of a construction machine that is not shown in further detail. The mast 10 can be attached in a pivotable and/or rotatable way on the construction machine. For this, the two articulation regions 40, 42 are used. The mast 10 can be telescopic or non-telescopic. FIG. 1 further shows the two winches 12, 14, which can be arranged on a carrier unit (not shown) of the construction machine. A hoist rope 20 is secured to the two winches 12, 14, the first rope winch 12 and the second rope winch 14. To wind in the hoist rope 20 the first rope winch 12 and the second rope winch 14 have a first winch drum 13 and a second winch drum 15. In the exemplary embodiment the first winch drum 13 and the second winch drum 15 have the same diameters and axial extensions. The hoist rope 20 extends from a first end, which is connected to the first winch drum 13, via a first deflection roller 18 on the mast head 11 of the mast 10 via a second deflection roller 18 through a pulley block 22 and back via a third deflection roller 18 and a fourth deflection roller 18 of the mast head 11 to the second winch drum 15, to which a second end of the hoist rope is connected. The first and the fourth deflection roller 18 are located on the same side of the mast as the two winches 12, 14 and the second and the third deflection roller 18 on the same side of the mast 10 as the pulley block 22. Two respective deflection rollers 18 are arranged at the mast head 11 lying opposite on a force measuring axis 19. A lifting element 30 is arranged on the pulley block 22 on a lower side. The lifting element 30, which is shown schematically in FIG. 1, serves as a connecting element to arrange a tool (not shown) on the pulley block 22. The tool can thereby be arranged rigidly or movably on the pulley block 22.

For free-wheeling lowering of the lifting element 30, the pulley block 22 and the tool, the first rope winch 12 can be designed as a free fall winch with a free fall brake that is not shown. Also, a controller 50 may be provided, with which the first rope winch 12 can be switched to a free fall mode to lower the hoist rope 20, while the second rope winch 14 is operated in a force-locking manner. Further, sensors 60 can be provided on the winches 12, 14 and determine the lengths of the wound-out hoist rope 20 of both winches 12, 14 and evaluate the lengths in particular in real time. The sensors 60 may be rotational speed sensors. Still further, the construction machine can be configured as a diaphragm wall gripper to excavate boring material, wherein a hydraulic gripper 70 is arranged on the lifting element 30.

FIG. 2 shows a perspective view of an articulation unit 24 with a lifting element 30. The only difference between this second embodiment and the first embodiment shown in FIG. 1 is that, instead of a pulley block 22 as present in the first exemplary embodiment, an articulation unit 24 is provided. The articulation unit 24 is designed so that it can be moved pivotably and is thus movable with respect to the indicated hoist rope 20. The hoist rope 20 is securely connected in this exemplary embodiment to the articulation unit 24, and it can be interrupted between the connection points. The lifting element 30 serves, as in the first exemplary embodiment, for securing a tool.

The invention claimed is:

1. A construction machine with a mast and a lifting element, which can be moved up and down along the mast with a hoist rope, which can be activated by means of at least a first rope winch and a second rope winch, wherein the first rope winch is designed as a free fall winch, wherein the hoist rope can be lowered in free fall, and a controller is provided, with which the first rope winch, which is designed as the free fall winch, can be switched into a free fall mode to lower the hoist rope while the second rope winch is operated with force-locking.

2. The construction machine according to claim 1, wherein the lifting element is arranged with a pulley block or an articulation unit to be movable on the hoist rope.

3. The construction machine according to claim 1, wherein the hoist rope is formed from at least two ropes coupled or connected to each other.

4. The construction machine according to claim 1, wherein the free fall winch has a free fall brake, with which the free fall winch can be opened for free-wheeling lowering of the hoist rope and the free falling hoist rope can be braked again by activating the free fall brake.

5. The construction machine according to claim 1, wherein each of the first rope winch and the second rope winch has a winch drum and a first end of the hoist rope is connected to a first winch drum of the first rope winch and a second end of the hoist rope is connected to a second winch drum of the second rope winch.

6. The construction machine according to claim 5, wherein after lowering the hoist rope from a starting position into an operating position, for the first rope winch a greater hoist rope length is wound out from the first winch drum than from the second winch drum, and the first rope winch and the second rope winch can be operated asynchronously when the hoist rope is lifted again, wherein when the hoist rope is lifted again a greater hoist rope length is wound onto the first winch drum than onto the second winch drum.

7. The construction machine according to claim 1, wherein the hoist rope can be deflected on at least two deflection rollers which are arranged on the mast, and the at least two deflection rollers are mounted on at least one force measuring axis.

8. The construction machine according to claim 1, wherein the construction machine has sensors, with which a position of the lifting element relative to a position of the construction machine can be determined.

9. The construction machine according to claim 1, wherein the construction machine has rotational speed sensors, with which the rotational speed of the first rope winch and the second rope winch can be determined.

10. The construction machine according to claim 1, wherein the first rope winch can be operated both as a free fall winch and also as a force-locking winch.

11. The construction machine according to claim 1, which is designed as a diaphragm wall gripper to excavate earth material, wherein a hydraulic gripper is articulated on the lifting element.

12. A method for creating a diaphragm wall with the construction machine according to claim 11.

13. A method for upward and downward movement of the lifting element in the construction machine according to claim 1, wherein the hoist rope is operated with first rope winch and the second rope winch, wherein the first rope winch, which is designed as the free fall winch, is used, and the first rope winch is switched into the free fall mode by the controller to lower the hoist rope while the second rope winch is operated with force-locking.

14. The method according to claim 13, wherein a free fall brake, which is arranged on the first rope winch, is deactivated for free fall lowering of the hoist rope and the lifting element, which is arranged to be movable on the hoist rope with a pulley block, wherein the first rope winch is released by the free fall brake for free fall lowering of the rope winch.

15. The method according to claim 13, wherein the first rope winch and the second rope winch are synchronized, when the hoist rope and the lifting element, which is arranged on the hoist rope, are lifted again after the free fall lowering of the hoist rope, into a starting position of the first rope winch and the second rope winch before lowering, and the first rope winch and the second rope winch are operated independently of each other when the hoist rope is lowered and/or lifted again.

* * * * *